US006893298B2

(12) United States Patent
Scarpellini et al.

(10) Patent No.: US 6,893,298 B2
(45) Date of Patent: May 17, 2005

(54) DEVICE FOR CONNECTING LOW-VOLTAGE DEVICES

(75) Inventors: Umberto Scarpellini, Ponteranica (IT); Luigi Arturo Degli Innocenti, Bergamo (IT)

(73) Assignee: ABB Service S.r.l., Milan (IT)

( * ) Notice: Subject to any disclaimer, the term of this patent is extended or adjusted under 35 U.S.C. 154(b) by 0 days.

(21) Appl. No.: 10/718,592

(22) Filed: Nov. 24, 2003

(65) Prior Publication Data

US 2004/0110409 A1 Jun. 10, 2004

(30) Foreign Application Priority Data

Dec. 5, 2002 (IT) ..... BG2002A0042

(51) Int. Cl.[7] ..... H01R 13/502
(52) U.S. Cl. ..... 439/701
(58) Field of Search ..... 439/701, 717, 439/638, 651

(56) References Cited

U.S. PATENT DOCUMENTS 3,273,107 A * 9/1966 Chandler ..... 439/717
4,469,393 A * 9/1984 Chewning, Jr. ..... 439/717
4,597,627 A 7/1986 Ulrich et al.
5,421,746 A * 6/1995 David ..... 439/701
6,206,733 B1 * 3/2001 Wu ..... 439/651
6,332,813 B1 12/2001 Okabe et al.
2003/0194914 A1 * 10/2003 Duck et al. ..... 439/701

FOREIGN PATENT DOCUMENTS

DE 196 51 961 A1 6/1998

OTHER PUBLICATIONS

EP Search Report dated Mar. 18, 2004, EP 03078739.4, EPO.

* cited by examiner

*Primary Examiner*—J. F. Duverne
*Assistant Examiner*—Phong Dinh
(74) *Attorney, Agent, or Firm*—Connolly Bove Lodge & Hutz LLP; Larry J. Hume

(57) ABSTRACT

A connection device for low-voltage electrical equipment, such as circuit breakers, disconnectors and isolators, and corresponding accessories, having a substantially parallel-epipedal structure with a first pair of faces, a second pair of faces, and a third pair of faces with the faces of each pair set opposite to one another. Each face of said first pair of faces is designed to receive electrical coupling means, whilst at least two faces of said second and third pairs of faces are equipped with mechanical coupling means for connection with said low-voltage equipment, and/or with a further connection device.

16 Claims, 12 Drawing Sheets

DEVICE FOR CONNECTING LOW-VOLTAGE DEVICES

FIELD OF THE INVENTION

The present invention relates to a connection device for low-voltage equipment and corresponding accessories and in particular to a connection device having improved characteristics particularly in terms of modularity and adaptability.

BACKGROUND OF THE INVENTION

Low-voltage equipment, and in particular low-voltage automatic circuit breakers and isolating or disconnecting switches are devices for protection and control, used generally in industrial electrical systems characterized by operating voltages of up to 1000 V. Automatic circuit breakers basically differ from isolating or disconnecting switches by the presence in the former of a device, the so-called protection relay, which controls the currents flowing in the device and supply the loads positioned downstream thereof, and brings about opening of the circuit in the event of failure or danger. To facilitate reading of the description and for sake of conciseness in the following we shall refer to the apparatuses thus designated as circuit breakers and disconnectors.

Moreover, various optional accessories that may provide circuit breakers and disconnectors with additional characteristics and functions are known in the art. Amongst such accessories it is possible for example to cite the following:

- relays for remote-controlled opening of the circuit (shunt-opening relays, or SORs);
- solenoids or motor-driven controls for opening and closing the switch and resetting the switch or circuit breaker;
- solenoids for opening the circuit of residual-current devices (RCDs);
- relays for remote-controlled closing of the circuit, (shunt-closing relays, or SCRs);
- so-called minimum-voltage protection relays, for protection against lowering or absence of voltage (under-voltage relays, or UVRs); and
- auxiliary contacts that supply indications on the state of the circuit breaker (open, closed, tripped).

The above accessories may be installed exclusively on circuit breakers and disconnectors pre-arranged for being equipped therewith. Furthermore, for the operation of these accessories, it is necessary to equip them with appropriate auxiliary electrical supply circuits or circuits for signal transmission. The commands and signals corresponding to these accessories are transmitted to and received from the parts of the electrical system belonging thereto by means of appropriate cables and terminals, which, in the known art, are in various ways located outside the circuit breaker or disconnector.

In the current state of the art, the solutions for connection of these electrical circuits for auxiliary supply or for transmission of the signal to other parts of the electrical system, albeit enabling provision of the required functions, present certain drawbacks and critical factors.

In particular, a first solution of a known type envisages making these connections by means of simple cables that projects outside the circuit breaker or disconnector directly from the accessory from which they derive, traversing in various ways the internal and external parts of the apparatus. It is clear that in these conditions interference of various kinds may occur between the cables and the electrical or mechanical parts that are located in the proximity of the path. This solution, which presents the cables outside the circuit breaker in the form of small bundles, entails the need for each cable to be characterized by specific markings to enable its identification and to prevent potential errors of connection. Frequently, these markings are subject to deterioration with the consequence of rendering the individual cables indistinguishable. This clearly has an adverse impact on the general reliability of the electrical wiring The known solutions prove particularly complex when the aim is to transform a wiring solution from fixed to extractable or vice versa. In these cases in fact, it is almost always necessary to dismantle and reconnect the accessories or even replace the means of connection thereof, such as for example sockets and plugs. Obviously, all these aspects have negative repercussions both on the overall costs of fabrication and on the costs of use and maintenance of circuit breakers and disconnectors in general.

SUMMARY OF THE INVENTION

A primary task of the present invention is to provide a connection device for electrical equipment, and in particular for low-voltage equipment, and corresponding accessories which will enable the drawbacks described previously to be overcome and in particular which, as compared to solutions of a known type, will have an optimized structure and functional performance.

In the context of this task, a purpose of the present invention is to provide a connection device for electrical equipment and corresponding accessories that presents a degree of modularity and reliability higher than do known solutions.

Yet a further purpose of the present invention is to provide a connection device for electrical equipment and corresponding accessories which, as compared to the systems of a known type, will enable elimination of the presence of free or additional cables or plugs that may expose installation to the risk of erroneous connection or interfere in some way with other electrical or mechanical parts present in the switchboard, improving at the same time the general conditions of safety and reliability for the installer and for the wiring system.

A further purpose of the present invention is to provide a connection device for electrical equipment and corresponding accessories which, as compared to the systems of a known type, will enable complete elimination, or at least a significant reduction of system.

A second solution used in practical applications envisages, instead, making the connections by means of plugs (terminal blocks or socket-plug assemblies) housed in purposely provided seats, made for example in the sides of the circuit breaker or disconnector. In this case, the number and type of slots obtainable in the internal space or in the sides of the circuit breaker or disconnector limits the number and type of accessories that can be connected using this method. Once all the slots available have been used, the addition of possible further accessories, provided that this is possible, must be obtained by means of free cables. Also this solution, in addition to presenting limits on the number of accessories that can be installed, may expose the system to the risk of undesirable interference between cables and plugs and the surrounding electrical and mechanical parts. Another limit frequently linked to this solution consists in having to replace some or all of the existing connections when it is desired to add a new accessory or pass from a fixed application to an extractable one.

The critical factors described above are particularly present when a high number of accessories is installed in the circuit breaker or disconnector. In fact, the quantity of free cables multiplies the risks of errors and interference. These risks typically arise whenever normal servicing is carried out on the system, namely, when in order to access the internal parts of the circuit breaker or disconnector it is necessary to remove temporarily one or more of the accessories present. Following upon any maintenance intervention, the accessories must in fact be re-installed in an exact way, but a wiring scheme that is far from intuitive exposes installation to wiring errors or omissions.

It should therefore not be neglected that both of these known solutions in any case involve a high degree of difficulty of the operations of assembly or disassembly of the accessories. the possible risks linked to the possibility of erroneous connection or to the attrition of cables and plugs with any moving parts.

Another purpose of the present invention is to provide a connection device for electrical equipment, in particular for circuit breakers and disconnectors, and corresponding accessories which will enable effective rationalization of use of the seats of the plugs, according to the type of accessories installed in circuit breakers or disconnectors whether fixed or extractable, in particular without having to replace the already existing connections when a new accessory is added.

Another purpose of the present invention is to provide a connection device for electrical equipment, in particular for circuit breakers and disconnectors, and corresponding accessories that will enable transformation of an application from fixed to extractable without modifying the plugs themselves, but only inserting appropriate adapter elements.

Yet another purpose of the present invention is to provide a connection device for electrical equipment and corresponding accessories that will enable the electromechanical installation to be made in a simplified way with respect to the known art and will give rise to schematic, orderly and clearly understandable configurations, in which the possibilities of error are virtually reduced to zero.

Yet a further purpose of the present invention is to provide a connection device for electrical equipment and corresponding accessories, practical installation of which will be obtained in a simplified way as compared to the known art, eliminating complex operations of electrical connection and mechanical assembly thereof.

Another purpose of the present invention is to provide a connection device for electrical equipment and corresponding accessories that will enable simultaneous installation of a wide range of applications, again in an intuitive and practical way, and at contained costs and with high reliability.

Yet another purpose of the present invention is to provide a connection device for electrical equipment and corresponding accessories that will exploit the principles of modularity and standardization so as to rationalize management of the electrical accessories, guaranteeing the adaptability and compatiblity between the electrical accessories inside the electrical equipment (shunt-opening relays, or under-voltage relays, and solenoids for opening the circuit of residual-current devices) and the ones external to the circuit breaker or disconnector (solenoid control or motor-driven control, or contacts for enabling under-voltage relays).

Not the least important purpose of the present invention is to provide a connection device for electrical equipment, and in particular for low-voltage equipment, and corresponding accessories that will enable high reliability, relative ease of construction and competitive costs.

The above task and the above purposes, as well as others that will emerge more clearly from what follows are achieved by a connection device for low-voltage electrical equipment, such as circuit breakers, disconnectors and the like, and corresponding accessories, which is characterized in that it has a substantially parallelepipedal structure with a first pair of faces, a second pair of faces, and a third pair of faces with the faces of each pair set opposite to one another, each face of said first pair of faces being designed to receive electrical coupling means, at least two faces of said second and third pairs of faces being equipped with mechanical coupling means for connection to said low-voltage equipment and/or to a further connection device.

In this way, thanks to its innovative structure, the device according to the invention makes possible connection of accessories of electrical equipment in a modular way and with a reduced number of components. Coupling between the various parts making up the connections is obtained in a direct way, according to an extremely simplified and at the same time functional and effective constructional solution.

BRIEF DESCRIPTION OF THE DRAWINGS

Further characteristics and advantages will emerge more clearly from the description of preferred but not exclusive embodiments of a connection device according to the invention, illustrated purely by way of indicative and non-limiting example with the aid of the annexed drawings, in which.

The connection device according to the invention will now be described with reference to a circuit breaker, as represented in some of the above figures, without wishing in any way to limit the field of application thereof, the connection device being applicable to low-voltage electrical equipment and apparatus in general and to the corresponding accessories. For the purposes of the present invention the term "low-voltage electrical equipment" is meant to refer to apparatuses such as circuit breaker, disconnectors, isolators and similar equipment.

DESCRIPTION OF THE PREFERRED EMBODIMENTS

Figure 1:
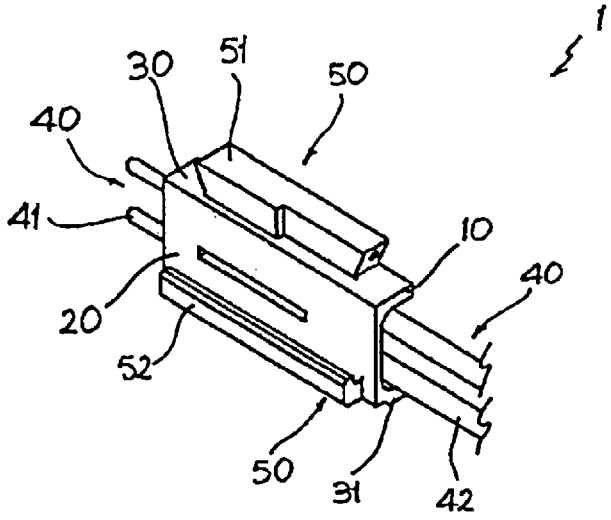
FIG. 1 is an axonometric view of a device according to the invention.

With reference to FIG. 1, the connection device for low-voltage electrical equipment and corresponding accessories, according to the invention, is designated, as a whole, by the reference number 1. The device has a substantially parallelepipedal structure with a first pair of faces set opposite to one another 10 and (not illustrated in the figure) 11, a second pair of faces set opposite to one another 20 and (not illustrated in the figure) 21, and a third pair of faces set opposite to one another 30 and (partially illustrated in the figure) 31. Each face 10 and 11 of said first pair is designed to receive electrical coupling means 40, which, in the embodiment of FIG. 1, are constituted by plugs 41 and cables 42. The connection device according to the invention is moreover characterized in that at least two faces of said second pair of faces 20, 21 and third pair of faces 30, 31 are equipped with mechanical coupling means 50 for connection to said low-voltage equipment and/or to a further connection device. In the embodiment of FIG. 1, said mechanical coupling means are constituted by a dovetail joint 51 positioned on the face 30 and by a shaped guide 52 positioned on the face 20.

Figure 2:
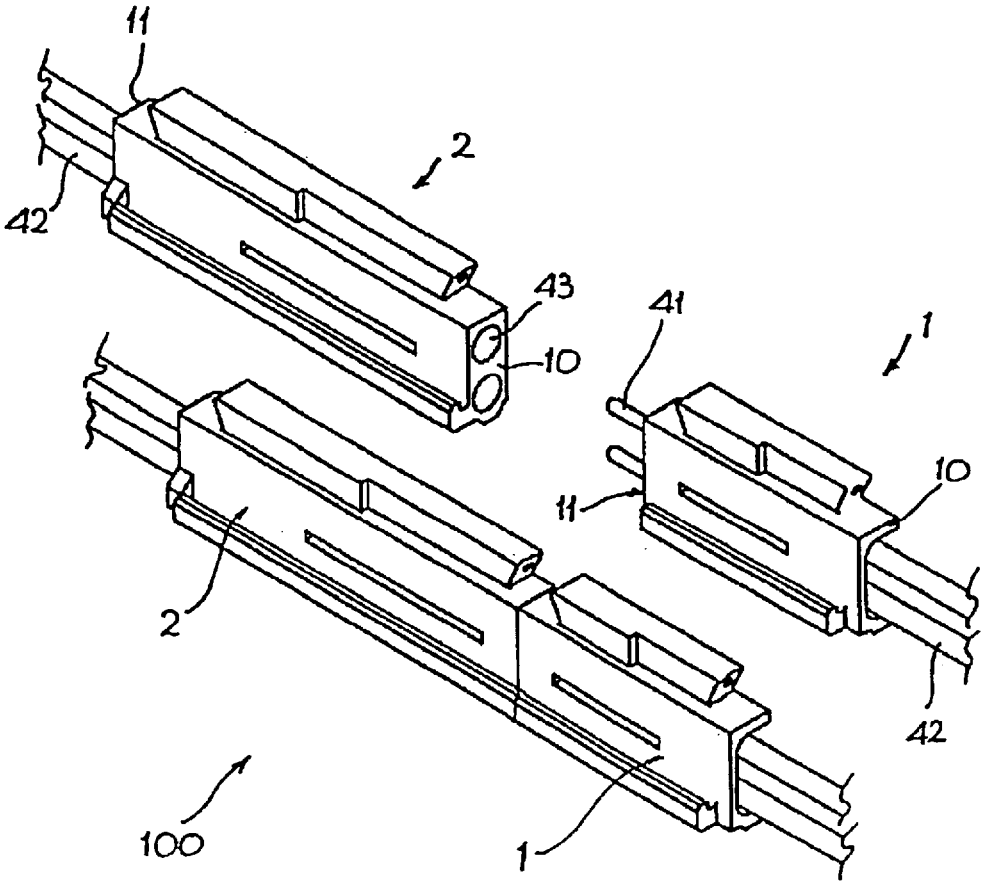
FIG. 2 illustrates the electrical coupling between two devices according to the invention.

Illustrated in FIG. 2 is a possible form of electrical connection between two connection devices according to the invention. According to this embodiment, a first connection device 1 is electrically connected, for example to an accessory of a low-voltage apparatus, by means of one or more cables 42 positioned on its face 10. The device 1 moreover has on its face 11, one or more plugs for electrical connection 41. A second connection device 2 is connected, for example to a corresponding part of the electrical wiring system, by means of one or more cables 42 positioned on its face 11. The device 2 moreover has on its face 10, one or more sockets 43 for said plugs 41 for electrical connection thereof. By coupling the plugs 41 with the corresponding sockets 43, there is obtained a subset 100 made up of the devices 1 and 2 electrically connected together.

It is clear that, according to the electrical coupling means present thereon, the devices according to the invention can basically be reduced to three types. A first type, designated in the attached figures by the reference numbers 1, 3 and 5, is represented by connection devices that have on one face of said first pair of faces 10 and 11 one or more cables 42, whilst on the other face of said first pair of faces 10, 11 are positioned one or more plugs 41. The devices thus obtained constitute plug modules which, as illustrated in the attached figures, may present a variable number of points of electrical contact.

A second type, designated in the attached figures by the reference numbers 2, 4 and 6, is represented by connection devices that have on one face of said first pair of faces 10 and 11 one or more sockets 43, whilst on the other face of said first pair of faces 10, 11 are positioned one or more cables 42. The devices thus obtained constitute socket modules which, as illustrated in the attached figures, may present a variable number of points of electrical contact.

A third type, designated in the attached figures by the reference number 7, is represented by connection devices that have on one face of said first pair of faces 10 and 11 one or more sockets 43, whilst on the other face of said first pair of faces 10, 11 are positioned one or more plugs 41. The devices thus obtained constitute adapter modules and/or extension modules, which, as illustrated in the attached figures, may present a variable number of points of electrical contact. It should moreover be emphasized that these adapter modules, as likewise the socket modules and the plug modules without the connections to the cables 42, may be used as adapters and covering caps according to embodiments that will be illustrated in detail in what follows.

Figure 3:
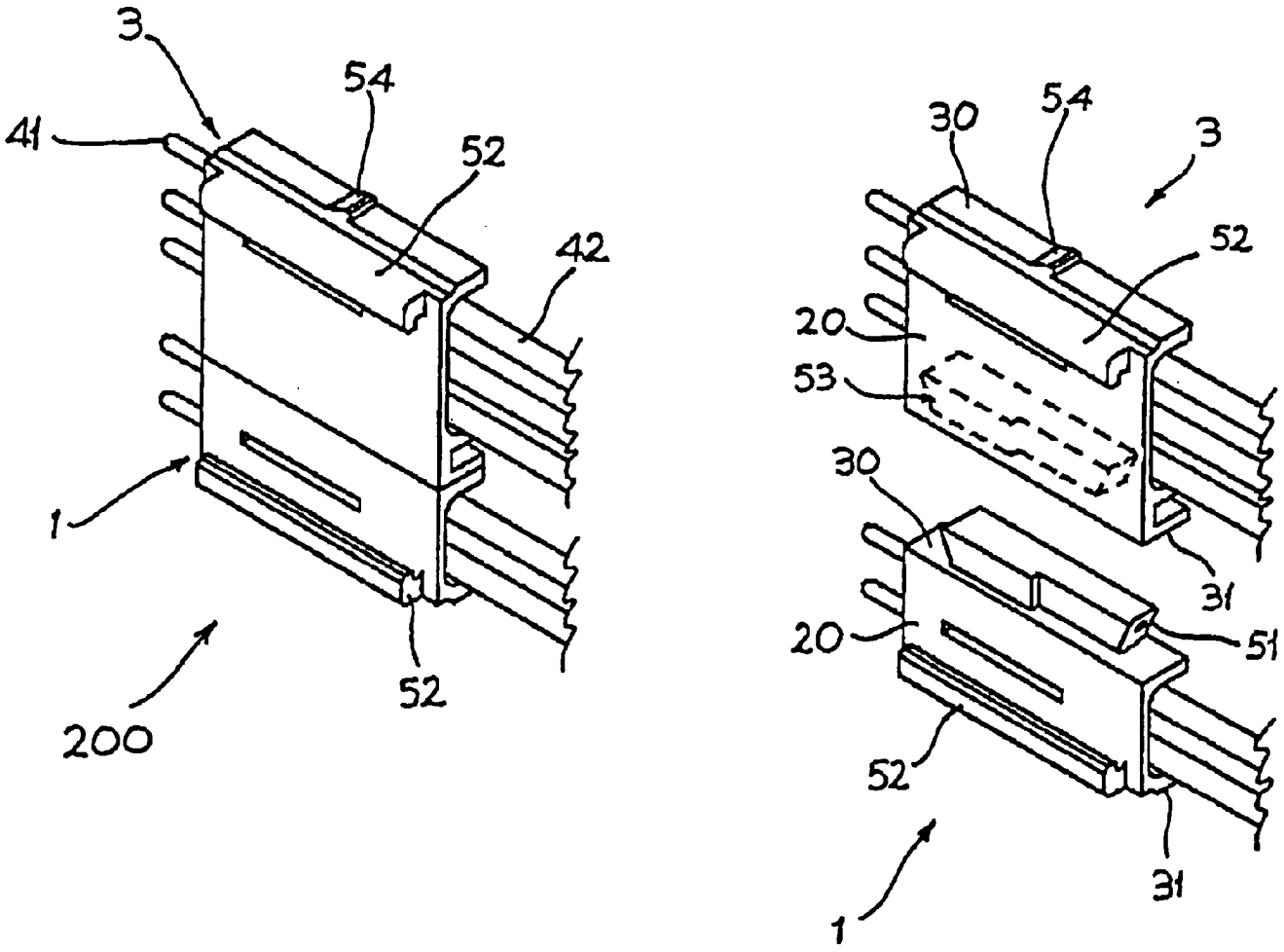
FIG. 3 illustrates a first form of mechanical coupling between two devices according to the invention.

With reference to FIG. 3, there is illustrated a possible form of mechanical coupling between two plug modules 1 and 3. The plug module 1 comprises on its face 30 mechanical coupling means constituted, for example, by dovetail-jointing means 51. Not illustrated in the figures, the plug module 1 also comprises mechanical coupling means for connection to the electrical equipment positioned on its face 31. Likewise, the plug module 3 comprises on its face 31 mechanical coupling means constituted, for example, by female dovetail-jointing means 53 that can be connected to the means 51 of the module 1. The plug module 3 further comprises mechanical coupling means for connection to the electrical equipment, constituted for example by a tooth 54 positioned on its face 30. By coupling the jointing means 51 and 53, there is obtained a subset 200 made up of the devices 1 and 3 mechanically connected together. The subset 200 has means 54 of mechanical coupling with the electrical equipment and, given the characteristics of modularity, may present a number of electrical connections, made up of the plugs 41 and the cables 42, which may vary according to the plug modules used for their construction. The plug modules 1 and 3, and consequently the subset 200, may moreover present mechanical coupling means, constituted for example by shaped guides 52, the function of which will be described in what follows.

Figure 4:
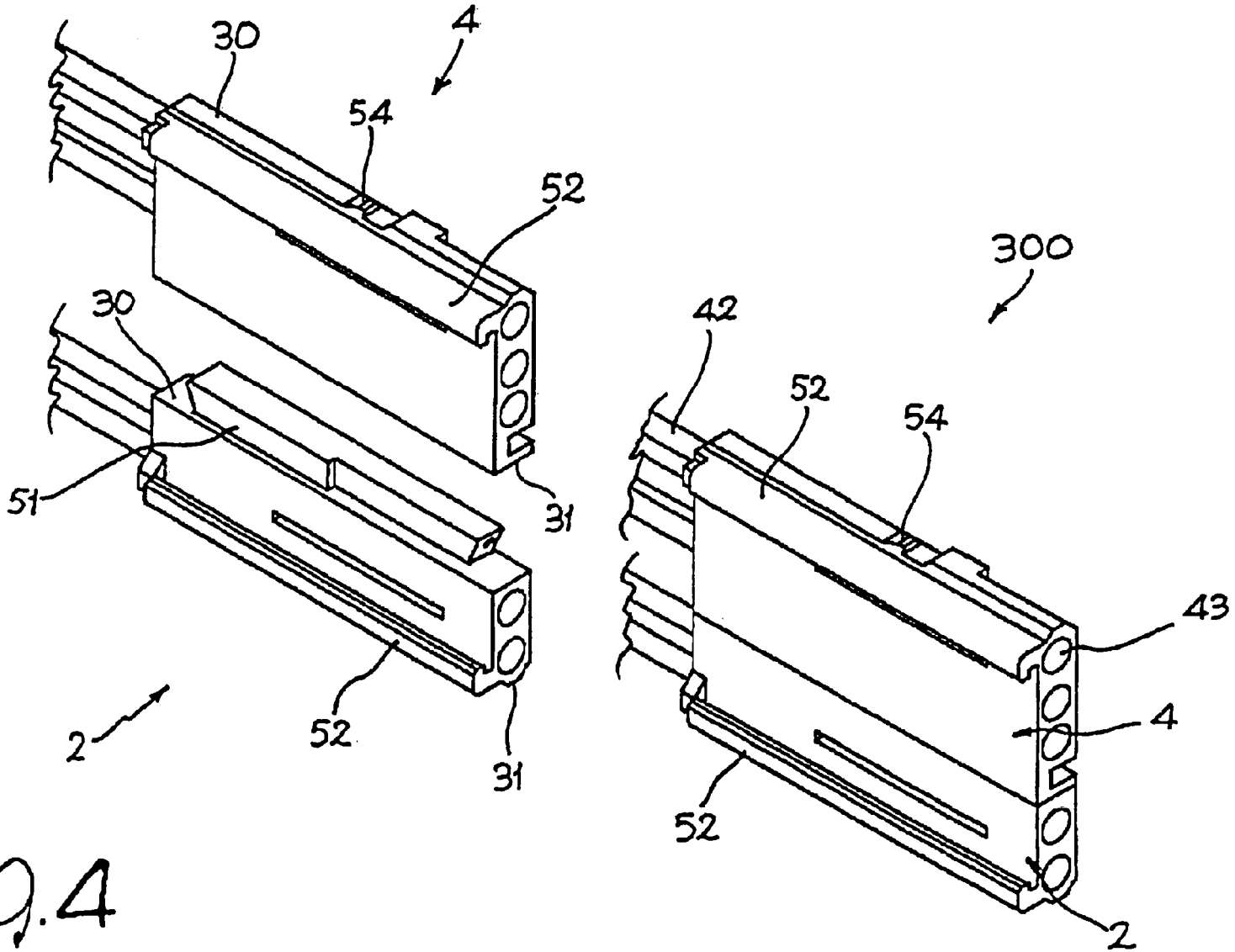
FIG. 4 illustrates the same form of mechanical coupling as the one illustrated in FIG. 3, made between two alternative embodiments of the device according to the invention.

The same type of structure may be obtained also with socket modules. With reference to FIG. 4, it may be seen in fact how two socket modules 2 and 4 may be coupled together to form a subset 300, using the same operating modalities described for the plug modules. The subset 300 has means 54 for mechanical coupling with the electrical equipment and, given the characteristics of modularity, may present a number of electrical connections, made up of the sockets 43 and cables 42, which may vary according to the plug modules used for their construction. The socket modules 2 and 4, and consequently the subset 300, may moreover present mechanical coupling means, constituted for example by shaped guides 52, the function of which will be described in what follows. It is interesting to note that the subset 200 and the subset 300 can be electrically coupled together.

Figure 5:
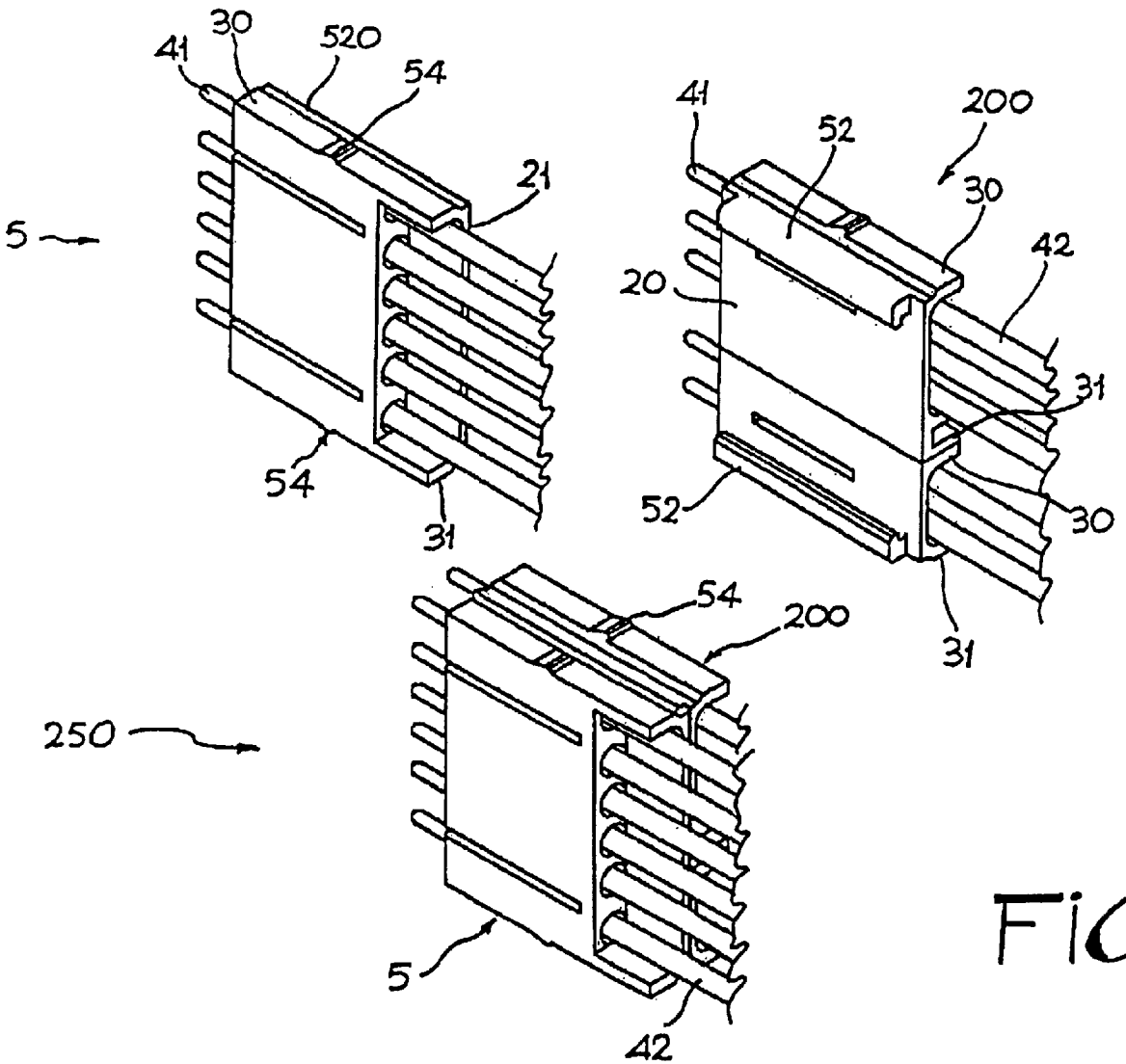
FIG. 5 illustrates a second form of mechanical coupling between three devices according to the invention.

An alternative embodiment, illustrated in FIG. 5, envisages that the connection device 5 will be provided, both on the face 30 and on the face 31, with mechanical means for coupling with the electrical equipment, constituted for example by teeth 54 positioned on said faces 30 and 31. Preferably, the height of said device 5 is equal to the height of the subset 200, the height being defined as the distance between the faces 30 and 31, on which the means 54 of mechanical coupling with the electrical equipment are positioned.

The connection device 5 is moreover preferably provided, in a position corresponding, for example, to one of the faces 21 of said second pair of faces 20 and 21, with mechanical means for coupling with a further connection device. These mechanical coupling means may be constituted, for example, by a groove 520, which can be coupled with a corresponding shaped guide 52, positioned, for example, on the face 20 of a device 1, 3 or of a subset 200. It may be seen from by FIG. 5 how, via the mechanical coupling means 52 and 520, it is possible to obtain a subset 250, in which two or more modules are mechanically coupled together in a position corresponding to their faces 20, 21. For example, in the embodiment of FIG. 5, the subset 250 is made up of the device 5 mechanically connected to the subset 200 in a position corresponding to the faces 20 and 21. In turn, the subset 200 is made up of the devices 1 and 3 mechanically connected together in a position corresponding to the faces 30, 31. The subset 250 has means 54 of mechanical coupling with the electrical equipment and, given the characteristics of modularity, may present a number of electrical connections, made up of the plugs 41 and cables 42, which may vary according to the plug modules used for its construction.

Figure 6:
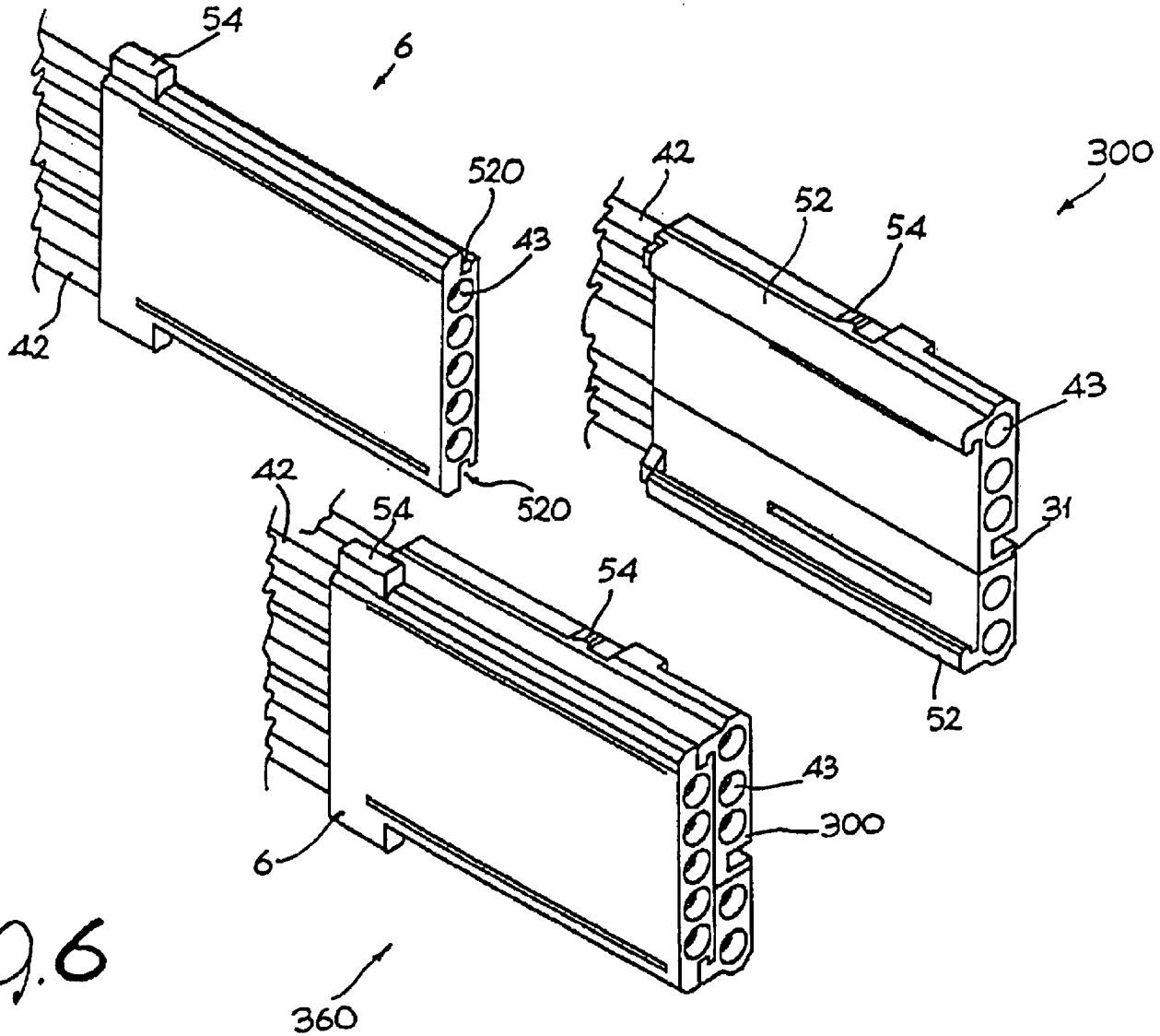
FIG. 6 illustrates the same form of mechanical coupling as the one illustrated in FIG. 5, obtained between three alternative embodiments of the device according to the invention.

The latter type of structure may be obtained also with socket modules. With reference to FIG. 6, it may in fact be noted how, using the same operating modalities described for the plug modules, a socket module 6 may be coupled with a subset 300, thus producing a subset 360. The subset 360 has means 54 of mechanical coupling with the electrical equipment and, given the characteristics of modularity, may present a number of electrical connections, made up of the sockets 43 and cables 42, which may vary according to the plug modules used for their construction.

Figure 7:
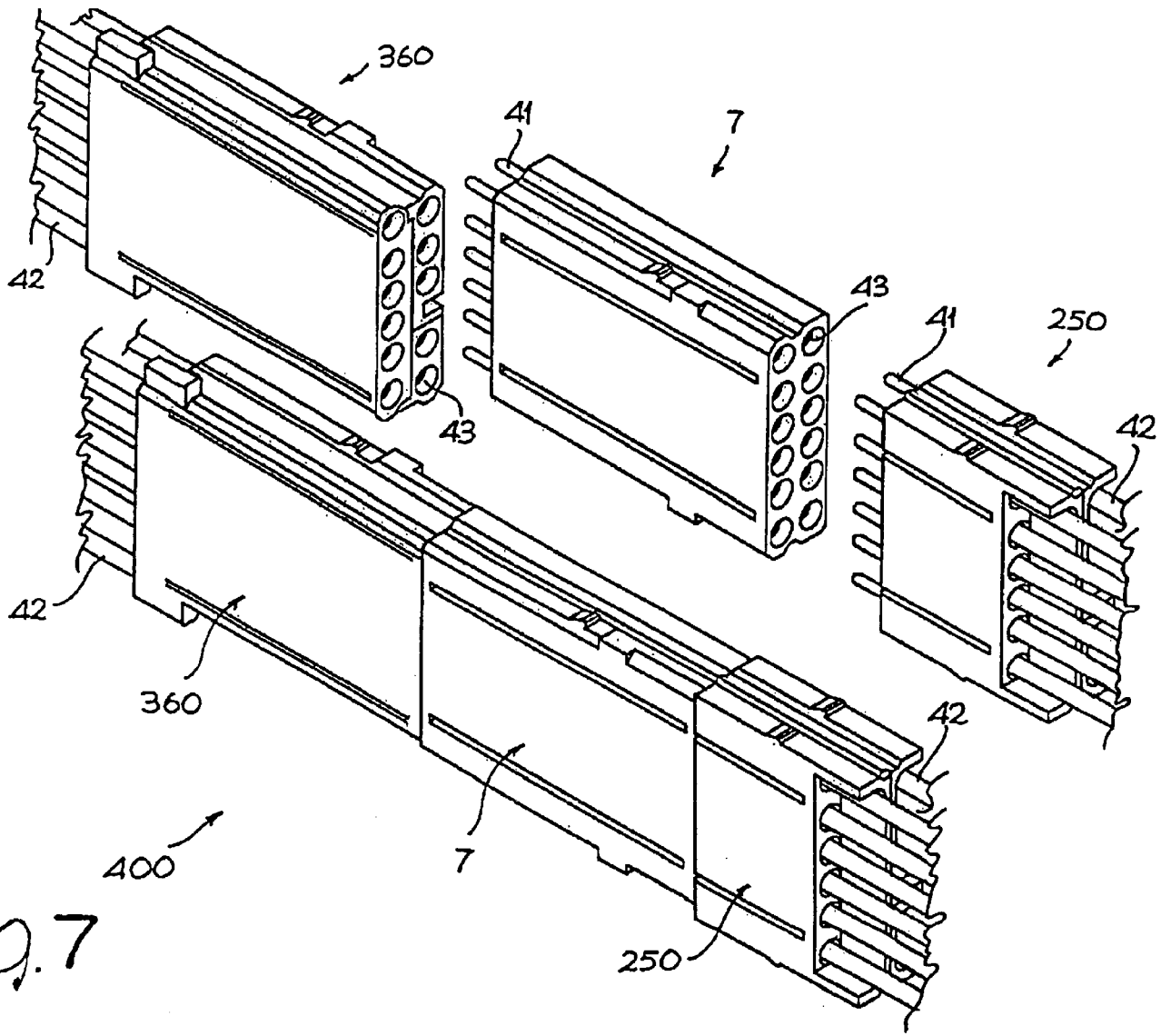
FIG. 7 illustrates the electrical and mechanical coupling between a plurality of devices according to the invention.

The modularity obtainable with the devices of the present invention is highlighted in FIG. 7. In this figure, it may be noted how in fact it is possible to vary the length of the subsets obtained, by means of the interposition of appropriate connection devices 7 having the function of adapter and/or extension. In particular, by interposing the device 7 between the subset 360 and the subset 250, there is obtained a subset 400 having a greater development in length, defining as length the distance between the faces 10 and 11, on which there are positioned the electrical coupling means 40. It is moreover to be noted how, via the subsets 360 and 250, it is possible to vary the thickness of the resulting structure by means of appropriate coupling of the devices in a position corresponding to the faces 20 and 21, the distance between the faces 20 and 21 of the second pair of faces being defined as thickness.

The mechanical coupling means 50 may for example be constituted by jointing means 51, 53, or else by sliding means 52, 520, or by other similar means.

The connection devices according to the invention find adequate application in low-voltage equipment, such as for example circuit breakers, disconnectors and the like. Some examples of application are illustrated in FIGS. 8 to 13.

Figure 8:
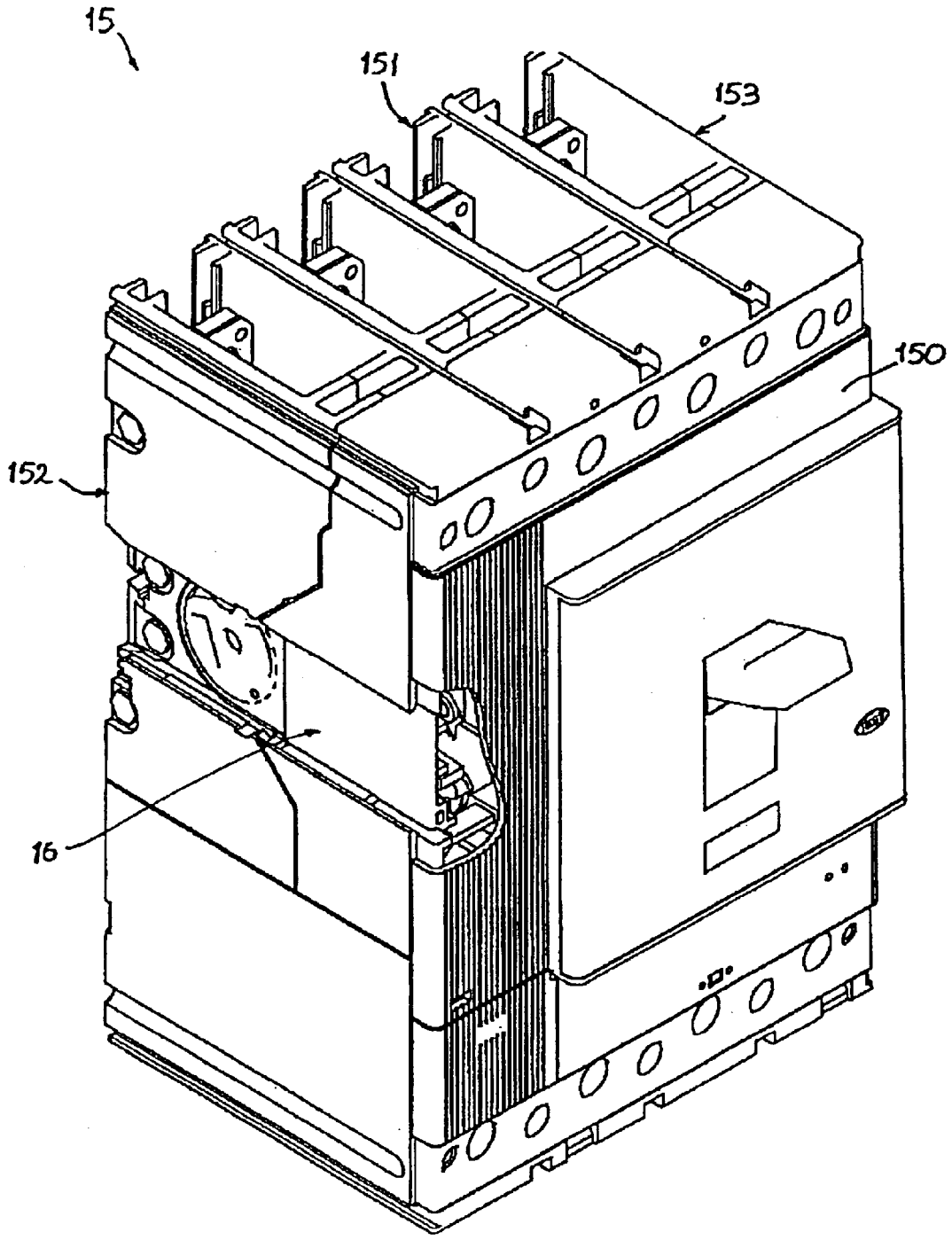
FIG. 8 is an axonometric view illustrating a circuit breaker having on its left-hand side a seat for one or more devices according to the invention.

With reference to FIG. 8, a low-voltage apparatus, for example a circuit breaker 15, is represented as a whole by a parallelepipedal structure having a front wall 150, a rear wall 151, a left-hand side wall 152, and a right-hand side wall 153. The terms "right-hand" and "left-hand" refer to a front view of the equipment. The devices according to the invention are advantageously housed in a seat 16 made in at least one of the side walls 151 and 152.

Figure 9:
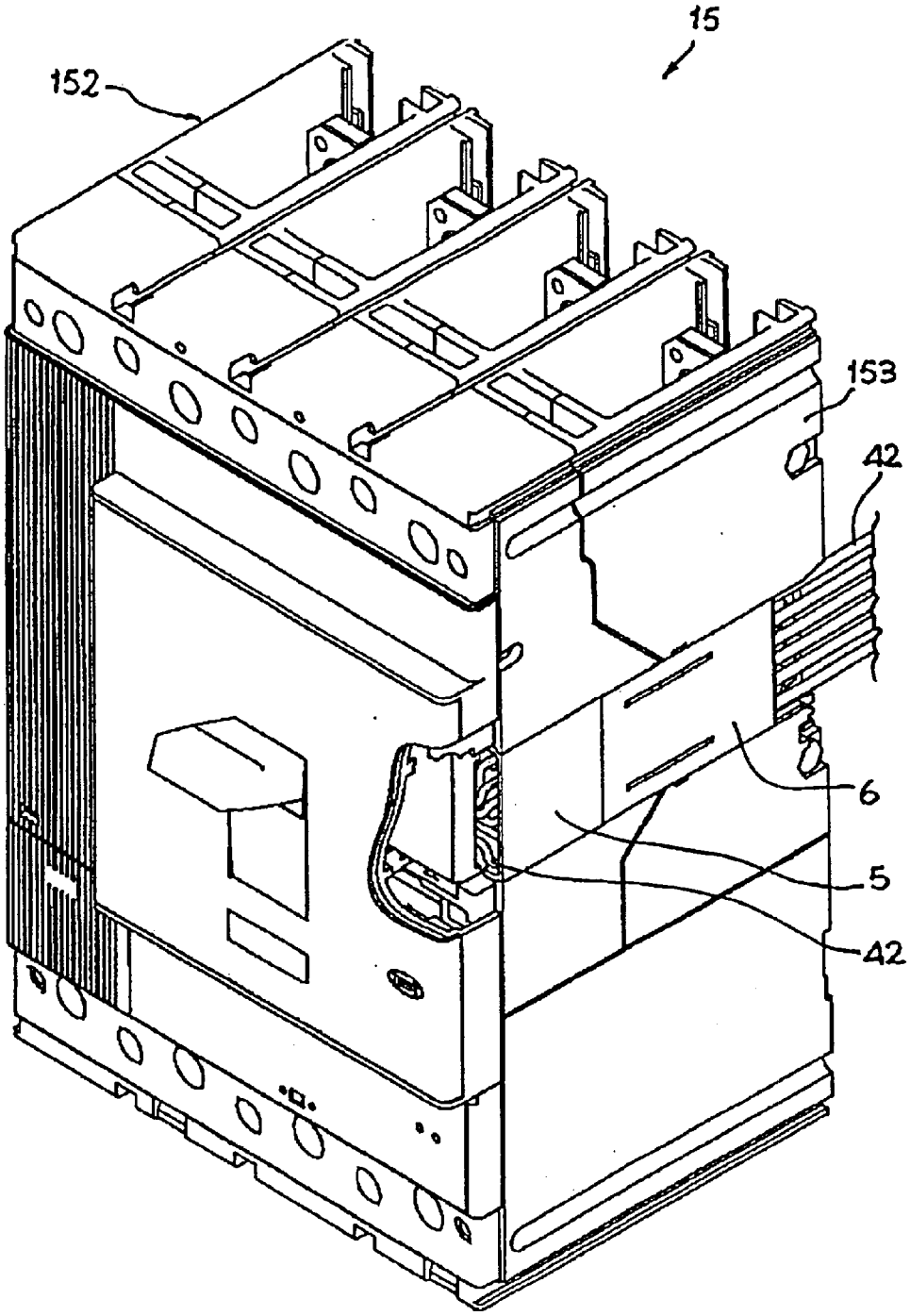
FIG. 9 is an axonometric view illustrating a circuit breaker with two devices according to the invention installed in a seat positioned on the right-hand side of the circuit breaker.

With reference to FIG. 9, the apparatus according to the invention comprises at least one first connection device 5 operatively connected to one or more accessories of said apparatus via the cables 42. There is moreover present at least one second connection device 6, operatively connected to the electrical wiring system via one or more cables 42. The devices 5 and 6 are electrically coupled with one another and are mechanically coupled with the electrical apparatus, for example by means of interaction between the edges of the seat 16 and the teeth 54, as illustrated previously.

Figure 10:
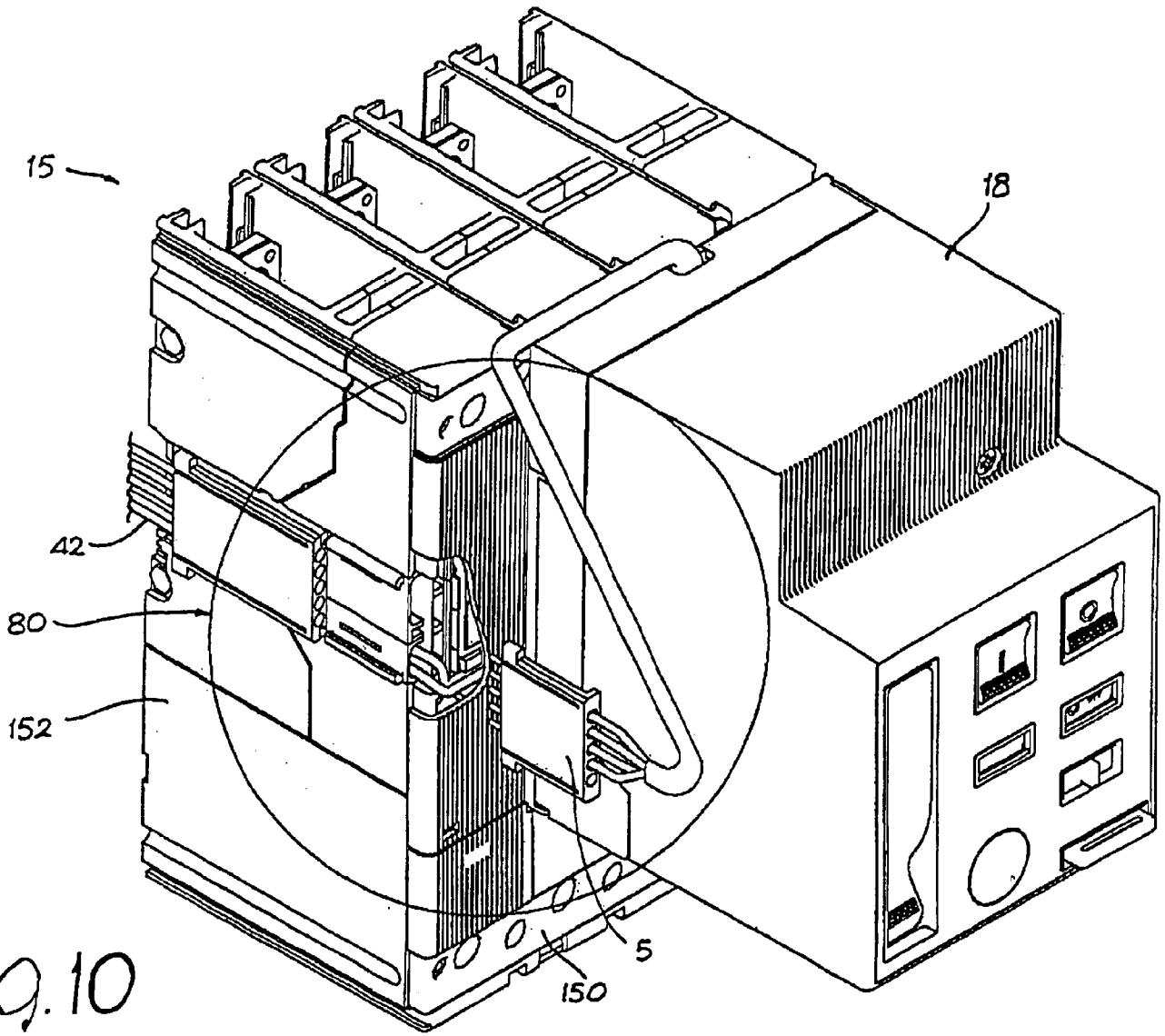
FIG. 10 is an axonometric view illustrating a circuit breaker on which there is installed a motor-driven control and the corresponding connection device according to the invention in the disconnected position.
Figure 11:
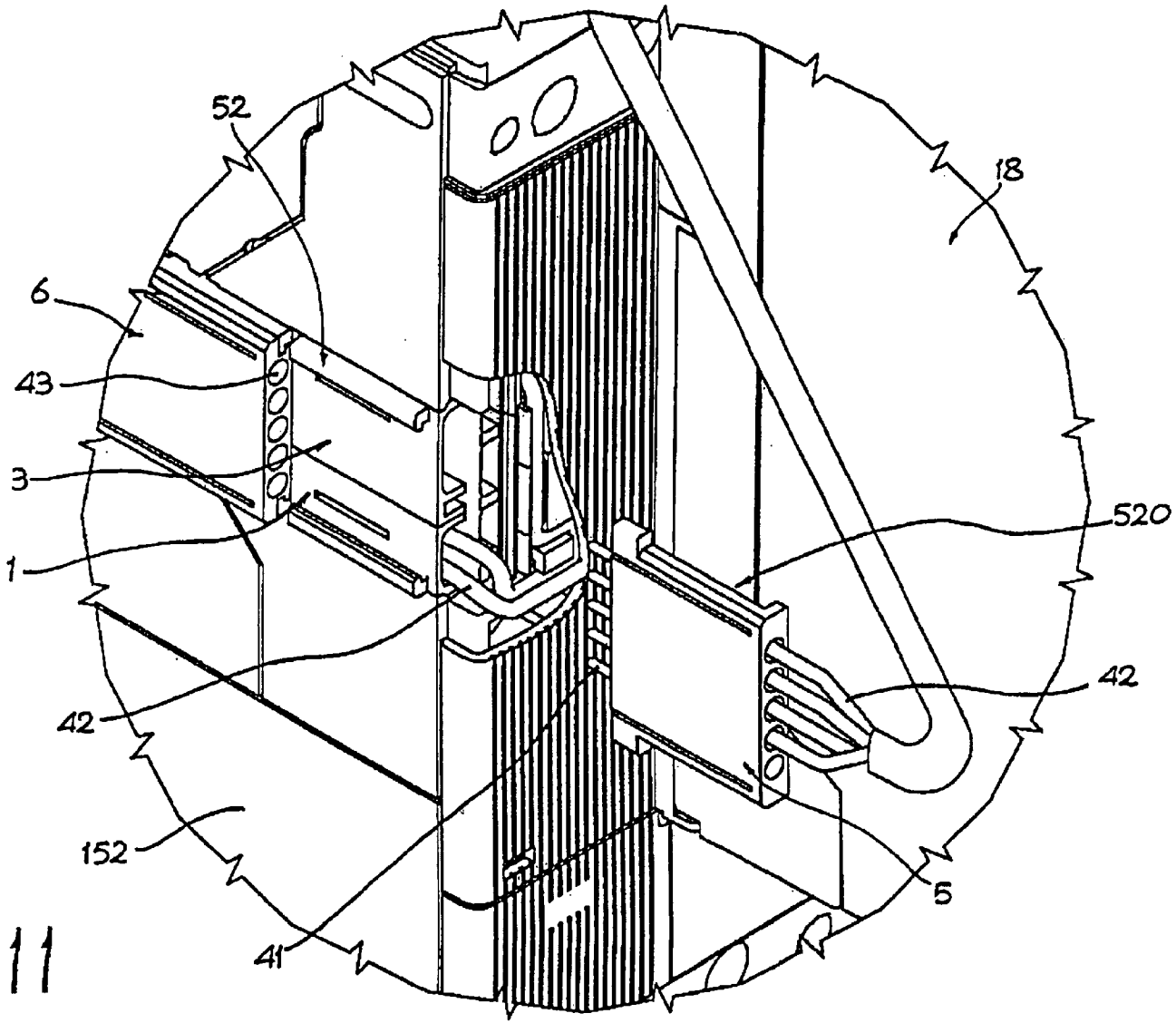
FIG. 11 is an enlarged view of a detail of FIG. 10.

A particular embodiment is illustrated in FIG. 10, which shows a circuit breaker 15 equipped with a motor-driven control 18 positioned on its front wall 150, with the corresponding connection device 5 in the disconnected position. The use of the connection devices according to the invention is detailed in FIG. 11, which presents an enlarged view of the portion of FIG. 10 enclosed in the circle 80. In FIG. 10 it is possible to see a first connection device 1, operatively connected by means of the cables 42 to an accessory of the circuit breaker and installed within the seat 16 on the side wall 152 of said circuit breaker. There is moreover visible a further connection device 3, mechanically coupled to the device 1. In the embodiment of FIG. 10, the device 3 is not operatively connected to any accessory and is used as adapter element, but it is in any case connectable to one or more accessories.

It is in fact possible to use devices that replicate the form of the normal socket or plug modules but are not wired; these modules have the function of occupying the parts of the area of the seat 16 not used by other modules, but available for installation of further accessories or subsequent applications.

Figure 12:
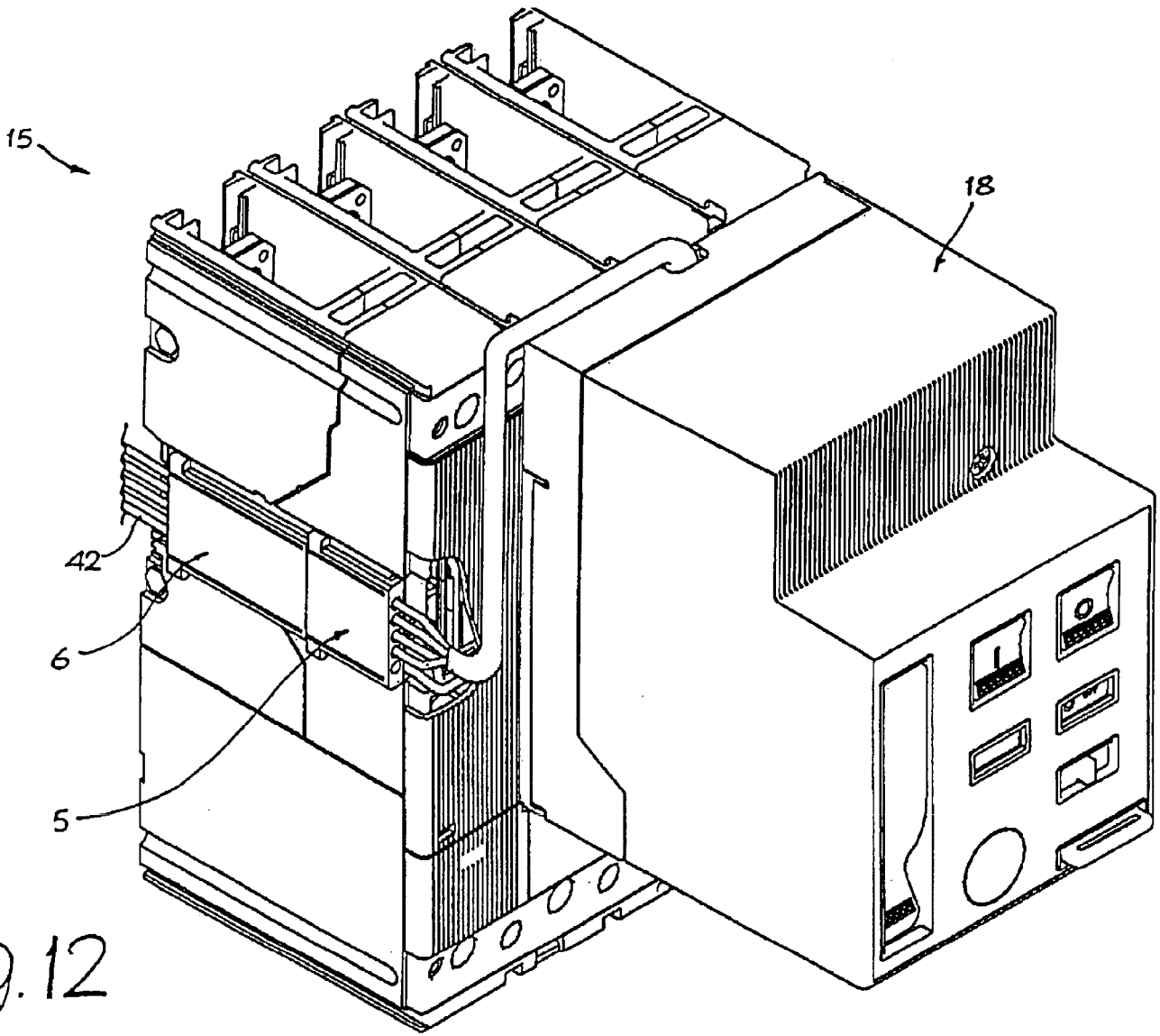
FIG. 12 is a view of the same circuit breaker as the one of FIG. 10 illustrating the connection device according to the invention in the connected position.

The devices 3 and 4 constitute in practice a subset similar to the subset 200 of FIG. 3, which can be coupled mechanically with the connection device 5. The device 5 is inserted in the seat 16 by mechanical coupling with the devices 1 and 3, and possibly also with the circuit breaker 15 and by electrical coupling with the device 6, for example by means of the insertion of the plugs 41 in the corresponding sockets 43. The final situation is illustrated in FIG. 12, in which it may be seen how the motor-driven control is connected, through the devices 5 and 6 (positioned on the body of the circuit breaker) and the cables 42, to the part of wiring system pertaining thereto.

Figure 13:
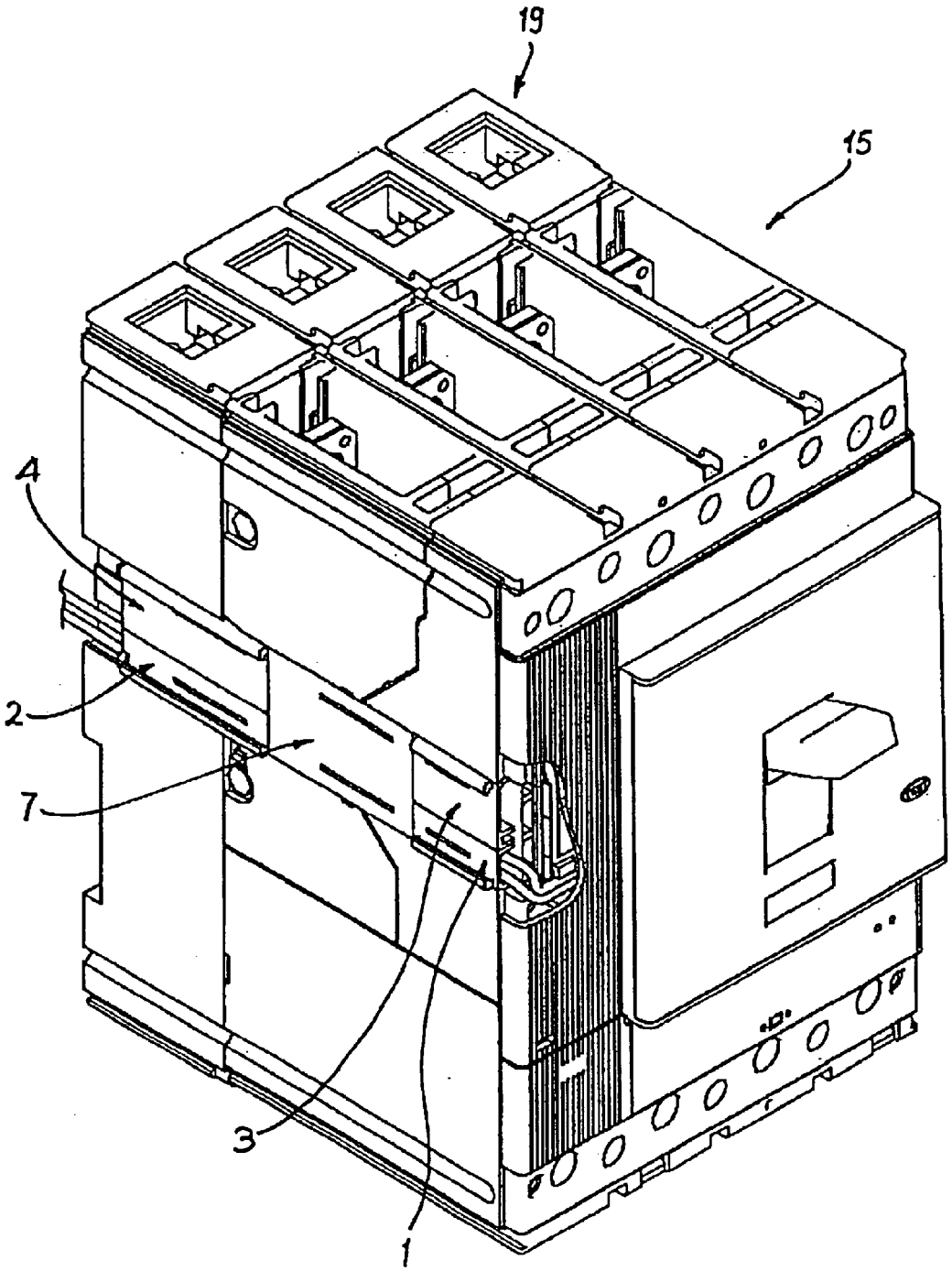
FIG. 13 is an axonometric view illustrating a circuit breaker in the extractable version provided with a plurality of devices according to the invention.

A further embodiment is illustrated in FIG. 13, which shows a circuit breaker 15 in the extractable version, installed on the corresponding element 19. In this case, at least one first connection device 1 is operatively connected to one or more accessories of the circuit breaker. A second connection device 2 is operatively connected to the electrical wiring system, whilst a third connection device 7 is set between said connection devices 1 and 2 in such a way that the first 1, second 2 and third 7 connection devices will be electrically coupled with one another and mechanically coupled with the circuit breaker. In FIG. 13 there are presented two further connection devices 3 and 4, mechanically coupled, respectively, to the devices 1 and 2. In practice, the devices 1 and 3 constitute a subset similar to the subset 200 illustrated in FIG. 3, whilst the subsets 2 and 4 constitute a subset similar to the subset 300 of FIG. 4. The assembly thus obtained between the devices 1, 3, 2, 4, and 7 constitutes a subset similar to the subset 400 of FIG. 7.

It is clear from FIG. 13 how the devices according to the invention make it possible to pass easily from a circuit breaker in a fixed version to a circuit breaker in the extractable version by means of simple interposition of an adapter device 7. Likewise clear are the advantages obtainable with the modular structure of the devices according to the invention which, by means of the appropriate combination of a number of devices, makes it possible to vary as desired the number of accessories and/or the characteristics of installation of the equipment.

It is, in practice, found that the connection device according to the invention performs fully the intended task, as well as the intended purposes, providing significant advantages with respect to the known art. In fact, thanks to its high characteristics of modularity it is easily possible to vary the number and/or the nature of the accessories present on a low-voltage apparatus, without having to resort to complicated and delicate operations of connection and wiring thereof. The presence of appropriate mechanical coupling in fact makes it possible to vary the height and/or the thickness of the subsets that may be made according to the needs of installation. Moreover, the possibility of being able to have available adapter elements that make it possible to vary the height, thickness or length of the subsets, enable standardization of the constructional characteristics of the circuit breaker, maintaining at the same time the advantages of the modular structure of the connection devices and hence the possibility of varying the number and the characteristics of the connections. Furthermore, it is possible to eliminate the presence of free or additional cables or plugs that might expose installation to the risk of erroneous connection or interfere in any way with other electrical or mechanical parts present on the switchboard.

We claim:

1. A connection device, comprising:

a substantially parallelepipedal structure with a first pair, a second pair and a third pair of faces set opposite to one another, wherein each face of the first pair of faces is designed to receive electrical coupling means, and at least two faces of the second and third pair of faces include mechanical coupling means for connection to a further connection device, wherein said mechanical coupling means for connection to a further connection device are positioned on one face of the third pair of faces; and mechanical coupling means suitable for connection to electrical equipment are positioned on another face of the third pair of faces.

2. The connection device of claim 1, wherein the mechanical coupling means is suitable for connection to low-voltage electrical equipment and corresponding accessories.

3. The connection device of claim 1, wherein the electrical coupling means comprise at least one of plugs, cables or sockets.

4. The connection device of claim 1, wherein:

one or more cables are positioned on one face of the first pair of faces; and one or more plugs are positioned on the other face of the first pair of faces.

5. The connection device of claim 1, wherein:

one or more sockets are positioned on one face of the first pair of faces; and one or more cables are positioned on the other face of the first pair of faces.

6. The connection device of claim 1, wherein:

one or more sockets are positioned on one face of the first pair of faces; and one or more plugs are being positioned on the other face of the first pair of faces.

7. The connection device of claim 2, wherein mechanical coupling means for connection to the electrical equipment are positioned on both of the faces of the third pair of faces.

8. The connection device of claim 1, wherein mechanical coupling means for connection to a further connection device are positioned on one face of the second pair of faces.

9. The connection device of claim 1, wherein the mechanical coupling means are jointing means.

10. The connection device of claim 1, wherein the mechanical coupling means are sliding means.

11. A low-voltage apparatus comprising:

a substantially parallelepipedal structure, with a front wall, a rear wall, and a first side wall and second side wall; and one or more connection devices, each comprising:

a substantially parallelepipedal structure with a first pair, a second pair and a third pair of faces set opposite in one another, wherein each face of the first pair of faces is designed to receive electrical coupling means, and at least two faces of the second and third pair of faces include mechanical coupling means, wherein the one or more of the connection devices are housed in a seat made in one of the side walls of the voltage apparatus.

12. The low-voltage apparatus of claim 11, wherein:

at least a first of the connection devices is operatively connected to one or more accessories of the low-voltage apparatus, and:

at least a second device of the connection devices is operatively connected to an electrical wiring system, wherein the first and second connection devices are electrically coupled with one another and mechanically coupled with the low-voltage apparatus.

13. The low-voltage apparatus of claim 11, wherein;

at least a first of the connection devices is operatively connected to one or more accessories of the low-voltage apparatus;

at least a second of the connection devices is operatively connected to an electrical wiring system;

at least a third of the connection devices is interposed between the first and second connection devices; and the first, second and third connection devices are electrically coupled with one another and mechanically coupled with the low-voltage apparatus.

14. The low-voltage apparatus of claim 11, wherein:

at least a first and a fourth of the connection devices are operatively connected to one or more accessories of the low-voltage apparatus;

at least a second and a fifth of the connection devices operatively are connected to the electrical wiring system;

the first and second connection devices arc electrically coupled with one another and mechanically coupled with the low-voltage apparatus;

the fourth and fifth connection devices are electrically coupled with one another and mechanically coupled with the low-voltage apparatus; and the first and second connection devices are mechanically coupled, respectively, with the fourth and fifth connection devices.

15. The low-voltage apparatus of claim 11, wherein the apparatus is a circuit breaker.

16. The low-voltage apparatus of claim 11, wherein the apparatus is a disconnector.

* * * * *